US006701891B2

(12) United States Patent
Niki et al.

(10) Patent No.: US 6,701,891 B2
(45) Date of Patent: Mar. 9, 2004

(54) THROTTLE CONTROL SYSTEM AND METHOD FOR INTERNAL COMBUSTION ENGINE AS WELL AS ENGINE CONTROL UNIT

(75) Inventors: Manabu Niki, Saitama-ken (JP); Eisei Yamazaki, Saitama-ken (JP); Manabu Sekine, Saitama-ken (JP); Takeru Tajima, Saitama-ken (JP); Yasuo Takagi, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/277,306

(22) Filed: Oct. 22, 2002

(65) Prior Publication Data

US 2003/0075146 A1 Apr. 24, 2003

(30) Foreign Application Priority Data

Oct. 22, 2001 (JP) ..... 2001-323057

(51) Int. Cl.[7] ..... F02D 9/10; F02D 11/10

(52) U.S. Cl. ..... 123/396; 123/399; 701/110

(58) Field of Search ..... 123/396, 399; 701/110

(56) References Cited

U.S. PATENT DOCUMENTS 6,167,866 B1 * 1/2001 Jakisch et al. ..... 123/396
6,390,062 B1 * 5/2002 Saito et al. ..... 123/399
6,431,144 B1 * 8/2002 Daly ..... 123/399
2001/0045202 A1 * 11/2001 Shimura et al. ..... 123/399

FOREIGN PATENT DOCUMENTS

JP 02002161758 A * 6/2002

OTHER PUBLICATIONS

US 5,146,866, 9/1992, Mannie et al. (withdrawn)*

* cited by examiner

*Primary Examiner*—Erick Solis
(74) *Attorney, Agent, or Firm*—Lahive & Cockfield, LLP

(57) ABSTRACT

There is provided a throttle control system and method for an internal combustion engine as well as an engine control unit, which are capable of controlling a throttle valve without any trouble even when the throttle valve is frozen. The throttle control system controls the degree of opening of the throttle valve. The opening of the throttle valve detected during control of the throttle valve to a fully-closed position at a start of the engine is set to a smallest angle. A temperature of the throttle valve is detected. A lower limit value of the target degree of opening is set to a degree of opening larger than the detected smallest angle of the throttle valve, when the detected smallest angle is larger than a predetermined degree of opening and at the same time the detected temperature of the throttle valve is lower than a predetermined temperature.

28 Claims, 5 Drawing Sheets

THROTTLE CONTROL SYSTEM AND METHOD FOR INTERNAL COMBUSTION ENGINE AS WELL AS ENGINE CONTROL UNIT

BACKGROUND OF THE INVENTION

1. Field of the Invention

This invention relates to a throttle control system and method for an internal combustion engine as well as an engine control unit, for controlling the degree of opening of a throttle valve arranged in an intake system of the engine.

2. Description of the Prior Art

Conventionally, a throttle control system of this kind has been proposed in Japanese Laid-Open Patent Publication (Kokai) No. 10-176548. In this throttle control system, when the amount of variation in the degree of opening of the throttle valve per unit time period has continued to be equal to or smaller than a predetermined value for a predetermined time period, with the duty factor of current flowing through a motor for actuating the throttle being equal to or larger than a predetermined value, it is determined that the motor is undesirably locked, and an electronic throttle control system is caused to go down. Further, the above predetermined time period set in the determination is set to a larger value when the temperature in the vicinity of the throttle valve is equal to or lower than a predetermined temperature. This is to cause the throttle control system to wait for a longer predetermined time period before execution of the determination for prevention of an erroneous determination, since when the ambient temperature of the throttle valve is low, there is a possibility that the motor is locked due to the freezing of the throttle valve itself or component parts associated therewith (hereinafter simply referred to as "the freezing of the throttle valve") which causes the throttle valve abuts against frozen ice to make the valve immovable, and in such a case, the frozen ice can be melted with a rise in the engine temperature to thereby restore the throttle valve to its normal operating condition.

However, the proposed conventional throttle control system suffers from the following problems: There can be a case where frozen ice is not melted even after the predetermined time period has elapsed, depending on the degree of freezing of the throttle valve. In such a case, it is erroneously determined that the throttle valve has failed, and the electronic throttle control system is caused to go down, so that the throttle valve cannot be controlled thereafter. Further, if the predetermined time period is set to a still longer time period to avoid the above inconvenience, the motor for actuating the throttle valve is caused to be driven for a long time period in a state where the throttle valve has a difficulty in moving due to the frozen ice therearound. The heat thus generated by the motor may cause failure or a shortened service life of the motor.

SUMMARY OF THE INVENTION

It is an object of the invention to provide a throttle control system and method for an internal combustion engine as well as an engine control unit, which are capable of controlling a throttle valve without any trouble even when the throttle valve is frozen.

To attain the above object, according to a first aspect of the present invention, there is provided a throttle control system for an internal combustion engine, for controlling a degree of opening of a throttle valve arranged in an intake system of the engine, the throttle control system comprising:

throttle valve opening-detecting means for detecting the degree of opening of the throttle valve;

target opening-setting means for setting a target degree of opening for control of the degree of opening of the throttle valve;

smallest opening-detecting means for detecting a smallest degree of opening of the throttle valve after a start of the engine;

throttle valve temperature-detecting means for detecting a temperature of the throttle valve; and target opening lower limit value-setting means for setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

According to this throttle control system, the smallest degree of opening of the throttle valve is detected, and when it is determined that the smallest degree of opening is larger than the predetermined degree of opening and at the same time the temperature of the throttle valve is lower than the predetermined temperature, the lower limit value of the target degree of opening of the throttle valve is set to a value larger than the detected smallest degree of opening. When the throttle valve is in such a low temperature condition as causes freezing thereof, the target degree of opening is set to a value larger than the smallest degree of opening. This prevents the throttle valve from abutting against frozen ice, whereby the throttle valve is controlled to the target degree of opening without any trouble. Further, when failure determination can be carried out based on the actual movement of the throttle valve, it is possible to positively prevent freezing of the throttle valve from causing an erroneous determination.

Preferably, the smallest degree of opening is a degree of opening of the throttle valve detected during control of the throttle valve to a fully closed position, at a start of the engine.

According to this preferred embodiment, a degree opening of the throttle valve detected during control of the throttle valve to a fully closed position at the start of the engine is set to the smallest degree of opening. Therefore, at the start of the engine, when the temperature of the engine is lower than the predetermined temperature, i.e. when it is estimated that the throttle valve is frozen, the advantageous effects as described above can be obtained.

Preferably, the throttle control system includes stuck state-detecting means for detecting a stuck state of the throttle valve, and the smallest degree of opening is an opening of the throttle valve detected when the stuck state-detecting means detects the stuck state of the throttle valve, after a start of the engine.

According to this preferred embodiment, a degree of opening of the throttle valve detected when the stuck state of the throttle valve is detected after the start of the engine is set to the smallest degree of opening. Therefore, when the engine is in such a low temperature condition as causes the freezing thereof, after the start of the engine, the advantageous effects as described above can be obtained.

For example, the predetermined degree of opening is a degree of opening of the throttle valve to be detected when the throttle valve is normally controlled to a fully-closed position.

Preferably, the predetermined degree of opening is set according to a learned fully-closed position value obtained by learning the degree of opening of the throttle valve detected when the throttle valve is controlled to a fully-closed position during a predetermined operation of the engine.

According to this preferred embodiment, the predetermined degree of opening used for determining whether or not the throttle valve is frozen is set according to the learned fully-closed position value obtained by learning the degree of opening of the throttle valve when the throttle valve is controlled to the fully-closed position. This makes it possible to accurately determine whether or not the throttle valve is frozen while causing changes in the operating characteristics of the throttle valve to be reflected on the determination.

Preferably, the throttle control system further comprises means for progressively degreasing the lower limit value of the target degree of opening from the degree of opening larger than the smallest degree of opening of the throttle valve as the temperature of the throttle valve detected by the throttle valve temperature-detecting means rises.

For example, the throttle valve temperature-detecting means detects at least one of a temperature of intake air and a temperature of coolant of the engine as the temperature of the throttle valve.

To attain the above object, according to a second aspect of the invention, there is provided a throttle control system for an internal combustion engine, for controlling a degree of opening of a throttle valve arranged in an intake system of the engine, the throttle control system comprising:

a throttle valve opening-detecting module for detecting the degree of opening of the throttle valve;

a target opening-setting module for setting a target degree of opening for control of the degree of opening of the throttle valve;

a smallest opening-detecting module for detecting a smallest degree of opening of the throttle valve after a start of the engine;

a throttle valve temperature-detecting module for detecting a temperature of the throttle valve; and a target opening lower limit value-setting module for setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

According to the second aspect of the invention, the same advantageous effects as provided by the first aspect of the invention can be obtained.

Preferably, the smallest degree of opening is a degree of opening of the throttle valve detected during control of the throttle valve to a fully closed position, at a start of the engine.

According to this preferred embodiment, the same advantageous effects as provided by the corresponding preferred embodiment of the first aspect of the invention can be obtained.

Preferably, the throttle control system includes a stuck state-detecting module for detecting a stuck state of the throttle valve, and the smallest degree of opening is a degree of opening of the throttle valve detected when the stuck state-detecting means detects the stuck state of the throttle valve, after a start of the engine.

According to this preferred embodiment, the same advantageous effects as provided by the corresponding preferred embodiment of the first aspect of the invention can be obtained.

For example, the predetermined degree of opening is a degree of opening of the throttle valve to be detected when the throttle valve is normally controlled to a fully-closed position.

Preferably, the predetermined degree of opening is set according to a learned fully-closed position value obtained by learning the degree of opening of the throttle valve detected when the throttle valve is controlled to a fully-closed position during a predetermined operation of the engine.

According to this preferred embodiment, the same advantageous effects as provided by the corresponding preferred embodiment of the first aspect of the invention can be obtained.

Preferably, the throttle control system further comprises a module for progressively degreasing the lower limit value of the target degree of opening from the degree of opening larger than the smallest degree of opening of the throttle valve as the temperature of the throttle valve detected by the throttle valve temperature-detecting module rises.

For example, the throttle valve temperature-detecting module detects at least one of a temperature of intake air and a temperature of coolant of the engine as the temperature of the throttle valve.

To attain the above object, according to a third aspect of the invention, there is provided a throttle control method for controlling a degree of opening of a throttle valve arranged in an intake system of an internal combustion engine, the throttle control method comprising the steps of:

detecting the degree of opening of the throttle valve;

setting a target degree of opening for control of the degree of opening of the throttle valve;

detecting a smallest degree of opening of the throttle valve after a start of the engine;

detecting a temperature of the throttle valve; and setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

According to the third aspect of the invention, the same advantageous effects as provided by the first aspect of the invention can be obtained.

Preferably, the smallest degree of opening is a degree of opening of the throttle valve detected during control of the throttle valve to a fully closed position, at a start of the engine.

According to this preferred embodiment, the same advantageous effects as provided by the corresponding preferred embodiment of the first aspect of the invention can be obtained.

Preferably, the throttle control method includes the step of detecting a stuck state of the throttle valve, and the step of smallest degree of opening is a degree of opening of the throttle valve detected when the stuck state of the throttle valve is detected in the step of detecting a stuck state, after a start of the engine.

According to this preferred embodiment, the same advantageous effects as provided by the corresponding preferred embodiment of the first aspect of the invention can be obtained.

For example, the predetermined degree of opening is a degree of opening of the throttle valve to be detected when the throttle valve is normally controlled to a fully-closed position.

Preferably, the predetermined degree of opening is set according to a learned fully-closed position value obtained by learning the degree of opening of the throttle valve detected when the throttle valve is controlled to a fully-closed position during a predetermined operation of the engine.

According to this preferred embodiment, the same advantageous effects as provided by the corresponding preferred embodiment of the first aspect of the invention can be obtained.

Preferably, the throttle control method further comprises the step of progressively degreasing the lower limit value of the target degree of opening from the degree of opening larger than the smallest degree of opening of the throttle valve as the detected temperature of the throttle valve rises.

For example, the step of detecting a temperature of the engine includes detecting at least one of a temperature of intake air and a temperature of coolant of the engine as the temperature of the throttle valve.

To attain the above object, according to a fourth aspect of the invention, there is provided an engine control unit including a control program for causing a computer to carry out control of a degree of opening of a throttle valve arranged in an intake system of an internal combustion engine, wherein the control program causes the computer to detect the degree of opening of the throttle valve, set a target degree of opening for control of the degree of opening of the throttle valve, detect a smallest degree of opening of the throttle valve after a start of the engine, detect a temperature of the throttle valve, and set a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

According to the fourth aspect of the invention, the same advantageous effects as provided by the first aspect of the invention can be obtained.

Preferably, the smallest degree of opening is a degree of opening of the throttle valve detected during control of the throttle valve to a fully closed position, at a start of the engine.

According to this preferred embodiment, the same advantageous effects as provided by the corresponding preferred embodiment of the first aspect of the invention can be obtained.

Preferably, the control program causes the computer to detect a stuck state of the throttle valve, and the smallest degree of opening is a degree of opening of the throttle valve detected when the stuck state of the throttle valve is detected, after a start of the engine.

According to this preferred embodiment, the same advantageous effects as provided by the corresponding preferred embodiment of the first aspect of the invention can be obtained.

For example, the predetermined degree of opening is a degree of opening of the throttle valve to be detected when the throttle valve is normally controlled to a fully-closed position.

Preferably, the predetermined degree of opening is set according to a learned fully-closed position value obtained by learning the degree of opening of the throttle valve detected when the throttle valve is controlled to a fully-closed position during a predetermined operation of the engine.

According to this preferred embodiment, the same advantageous effects as provided by the corresponding preferred embodiment of the first aspect of the invention can be obtained.

Preferably, the control program causes the computer to progressively degrease the lower limit value of the target degree of opening from the degree of opening larger than the smallest degree of opening of the throttle valve as the detected temperature of the throttle valve rises.

For example, the control program causes the computer to detect at least one of a temperature of intake air and a temperature of coolant of the engine as the temperature of the throttle valve.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
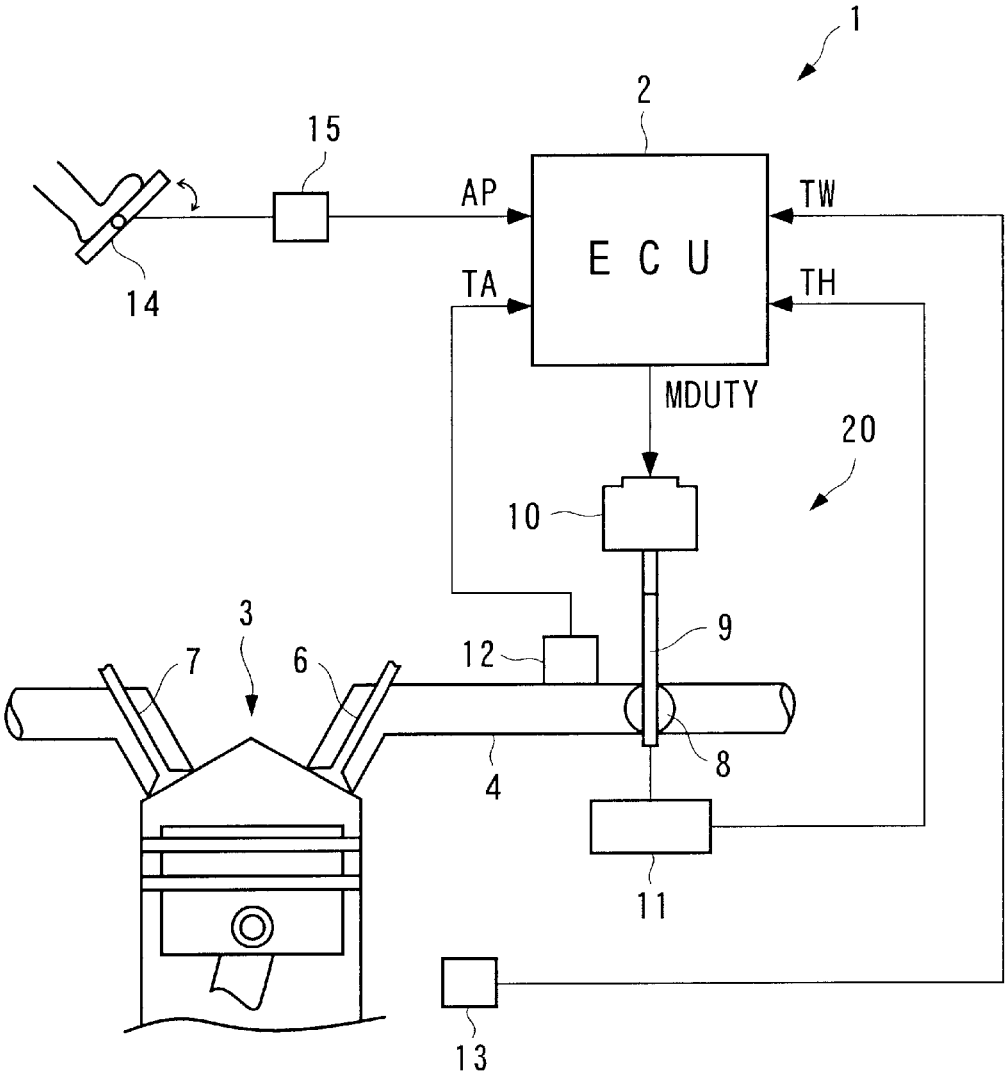
FIG. 1 is a block diagram schematically showing the arrangement of an internal combustion engine incorporating a throttle control system to which is applied the present invention.

The invention will now be described in detail with reference to the drawings showing preferred embodiments thereof. Referring first to FIG. 1, there is schematically shown the arrangement of an internal combustion engine 3 incorporating a throttle control system 1 according to an embodiment of the invention. As shown in the figure, the throttle control system 1 includes an ECU 2 (target opening-setting means, target opening lower limit value-setting means, smallest opening-detecting means, stuck state-detecting means). In the present embodiment, the ECU 2 carries out control processes, described hereinbelow.

The internal combustion engine (hereinafter simply referred to as "the engine") 3 has an intake valve 6 and an exhaust valve 7 arranged therein. Further, the engine 3 has an intake pipe 4 having a throttle valve 8 arranged therein. The throttle valve 8 is connected to a drive shaft of a motor 10 via a throttle shaft 9. The motor 10 is implemented by a DC motor, for example. The degree of opening (hereinafter referred to as "the throttle valve opening") TH of the throttle valve 8 is controlled by controlling a duty factor value MDUTY of a drive current supplied to the motor 10 by the ECU 2. That is, the throttle valve 8 and the motor 10 constitutes a motor-driven throttle mechanism (hereinafter referred to as "the DBW") 20.

The throttle valve 8 has a throttle valve opening sensor 11 (throttle valve opening-detecting means) attached thereto. The intake pipe 4 has an intake air temperature sensor 12 (throttle valve temperature-detecting sensor) inserted therein at a location downstream of the throttle valve 8. The throttle valve opening sensor 11 senses the throttle valve opening TH, and delivers a signal indicative of the sensed throttle valve opening TH to the ECU 2. The intake air temperature sensor 12 senses a temperature (intake air temperature TA) of intake air within the intake pipe 4 and delivers a signal indicative of the sensed intake air temperature TA to the ECU 2.

Further, an engine coolant temperature sensor 13 (throttle valve temperature-detecting means) is mounted in a cylinder block, not shown, of the engine 3. The engine coolant temperature sensor 13 senses a temperature (engine coolant temperature TW) of an engine coolant circulating through the cylinder block of the engine 3 and delivers a signal indicative of the sensed engine coolant temperature TW to the ECU 2. Further, an accelerator pedal sensor 15 detects an accelerator pedal opening AP, which represents an operation amount i.e. stepping amount of an accelerator pedal 14 operated by a driver, and delivers a signal indicative of the sensed accelerator pedal opening AP to the ECU 2.

The ECU 2 is implemented by a microcomputer including an I/O interface, a CPU, a RAM, and a ROM, none of which are shown. The signals from the above sensors are each input to the CPU after A/D conversion and waveform shaping by the I/O interface.

The CPU carries out control of the DBW 20 according to control programs and data stored in the ROM, and data stored in the RAM in response to the above input signals. More specifically, the CPU sets a target degree of opening of the throttle valve 8 according to the sensed accelerator pedal opening AP and the like, determines a duty factor value MDUTY of a drive current supplied to the motor 10 based on the target degree of opening, and delivers a drive signal based on the determined duty factor value MDUTY to the motor 10, to thereby control the throttle valve opening TH. The control of the DBW 20 includes idle rotational speed control for controlling a target idle rotational speed of the engine 3 during idling thereof.

Figure 2:
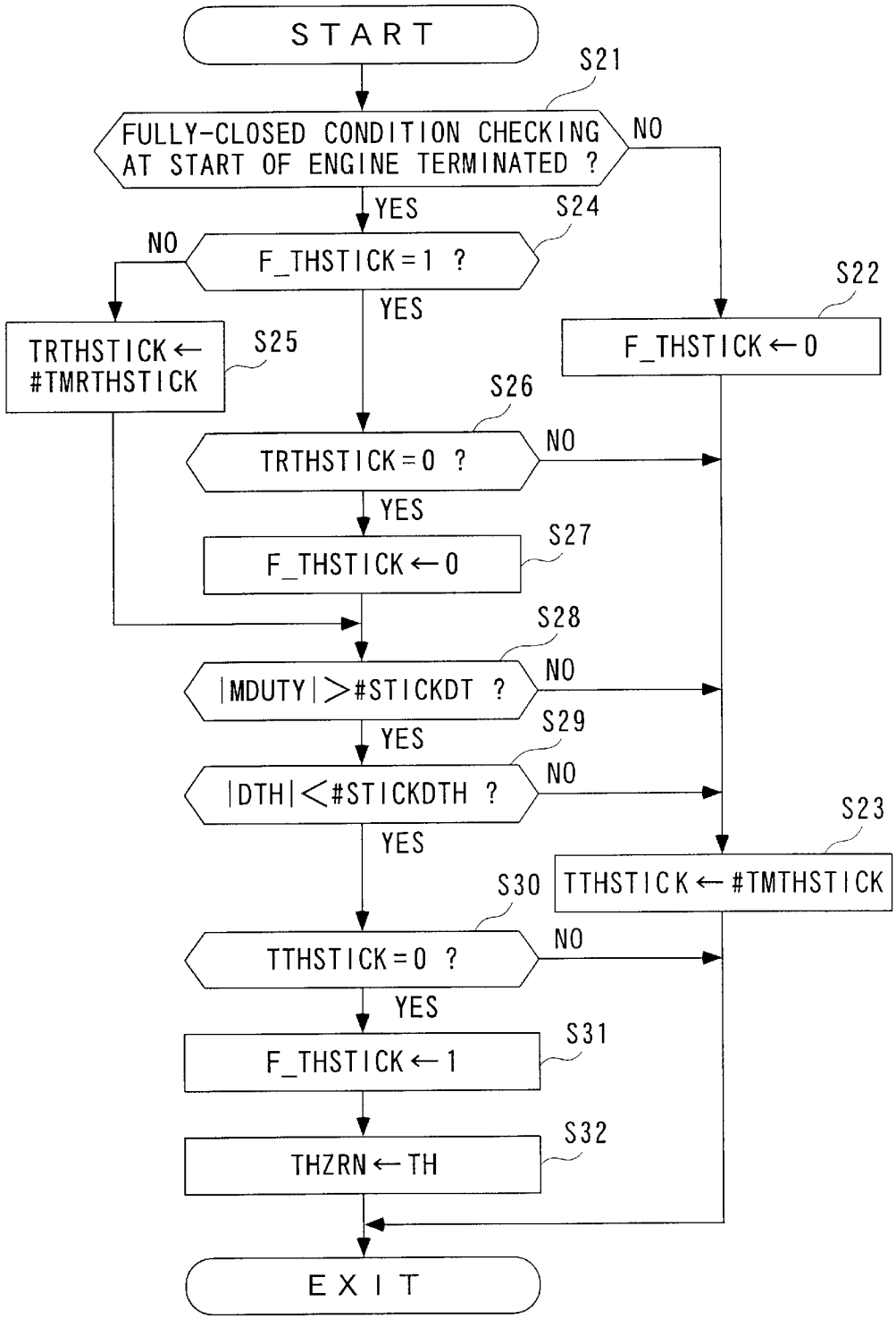
FIG. 2 is a flowchart of a sticking-detecting process for detecting whether or not a throttle valve is stuck.

FIG. 2 is a flowchart of a sticking-detecting process carried out by the ECU 2 for detecting whether or not the throttle valve 8 is stuck. This process detects whether or not the throttle valve 8 is undesirably locked (stuck) e.g. due to freezing of the throttle valve 8 or a failure of the DBW 20 and detects the throttle valve opening TH of the throttle valve in the stuck state, as a smallest degree of opening THZRN. First, in a step 21 (in the figures, shown as "S21", which rule applies similarly in the following description), it is determined whether or not a process for checking a fully-closed condition of the throttle valve 8 has been terminated. This process forcibly causes the throttle valve 8 to be fully closed at the start of the engine 3, and then checks whether or not the throttle valve 8 is normally operating based on the throttle valve opening TH detected of the throttle valve 8 controlled to the fully-closed condition.

If the answer to the question of the step 21 is negative (NO), which means that the process for checking a fully-closed condition of the throttle valve 8 has not yet been terminated, a throttle stick flag F_THSTICK is set to 0 in a step 22, and a timer TTHSTICK of a downcount type is set to a predetermined time period #TMTHSTICK (e.g. one second) in a step 23, followed by terminating the present program.

If the answer to the question of the step 21 is affirmative (YES), i.e. if the process for checking a fully-closed condition of the throttle valve 8 has been terminated, it is determined in a step 24 whether or not the throttle stick flag F_THSTICK assumes 1. If the answer to this question is negative (NO), i.e. if F_THSTICK=0 holds, a timer TRTHSTICK of a downcount type is set to a predetermined time period #TMRTHSTICK (e.g. 20 seconds) in a step 25, followed by the program proceeding to a step 28.

In the step 28, it is determined whether or not the absolute value |MDUTY| of the duty factor value of the drive current supplied to the motor 10 is larger than a predetermined value #STICKDT (e.g. 80%). This determination is carried out to determine whether or not the motor 10 for actuating the throttle valve 8 is driven by a relatively large current. If the absolute value |MDUTY| is larger than the predetermined value #STICKDT, it is considered that the throttle control system 1 has increased the duty factor value MDUTY by feedback control in response to a condition that the throttle valve opening TH does not reach the target degree of opening for some reason. The absolute value of the duty factor value MDUTY is used for the following reason: The DBW 20 includes a mechanism for holding the throttle valve 8 at a predetermined degree of opening (hereinafter referred to as "the default opening degree"), corresponding to a position slightly opened from a fully-closed position to enable the automotive vehicle to run for stoppage even if power supply to the DBW 20 is stopped when the DBW 20 or the throttle control system 1 goes out of order, so that when the throttle valve opening TH is caused to be reduced from the default opening degree, the duty factor value MDUTY assumes a negative value. If the answer to the question of the step 28 is negative (NO), i.e. if |MDUTY|≦#STICKDT holds, the program proceeds to the step 23, wherein the timer TTHSTICK is set to the predetermined time period #TMTHSTICK, followed by terminating the program.

If the answer to the question of the step 28 is affirmative (YES), it is determined in a step 29 whether or not the absolute value |DTH| of the difference (amount of variation in the throttle valve opening TH) between the present value and immediately preceding value of the throttle valve opening TH is smaller than a predetermined value #STICKDTH (e.g. 0.1 degree). If the answer to this question is negative (NO), i.e. if |DTH|≧#STICKDTH holds, the step 23 is executed, followed by terminating the program.

If the answer to the question of the step 29 is affirmative (YES), the program proceeds to a step 30, wherein it is determined whether or not the count of the timer TTHSTICK set in the step 23 is equal to 0. If the answer to this question is negative (NO), the present program is immediately terminated, whereas if it is affirmative (YES), i.e. if a state where the conditions of |MDUTY|>#STICKDT and |DTH|<#STICKDTH hold has continued for the predetermined time period #STICKDTH, it is judged that the throttle valve 8 is stuck since the throttle valve opening TH is hardly changed although a drive current having a relatively large duty factor value is being supplied to the motor 10 to actuate the throttle valve 8, and the throttle stick flag F_THSTICK is set to 1 to indicate the fact in a step 31. Then, the throttle valve opening TH detected in the present loop is set to the smallest degree of opening THZRN in a step 32, followed by terminating the program.

After the throttle stick flag F_THSTICK has been set to 1 in the step 31, the answer to the question of the step 24 becomes affirmative (YES). In this case, the program proceeds to a step 26, wherein it is determined whether or not the count of the timer TRTHSTICK set in the step 25 is equal to 0. If the answer to this question is negative (NO), the step 23 is executed, whereas if the answer to this question is affirmative (YES), the program proceeds to a step 27, wherein the throttle stick flag F_THSTICK is reset to 0, followed by the program proceeding to the steps 28 et seq. More specifically, once it is detected that the throttle valve 8 is stuck, detection of sticking of the throttle valve 8 is suspended until the predetermined time period #TMRTHSTICK has elapsed, and after the predetermined time period #TMRTHSTICK has elapsed, the next detection of the sticking of the throttle valve 8 is carried out.

Figure 3:
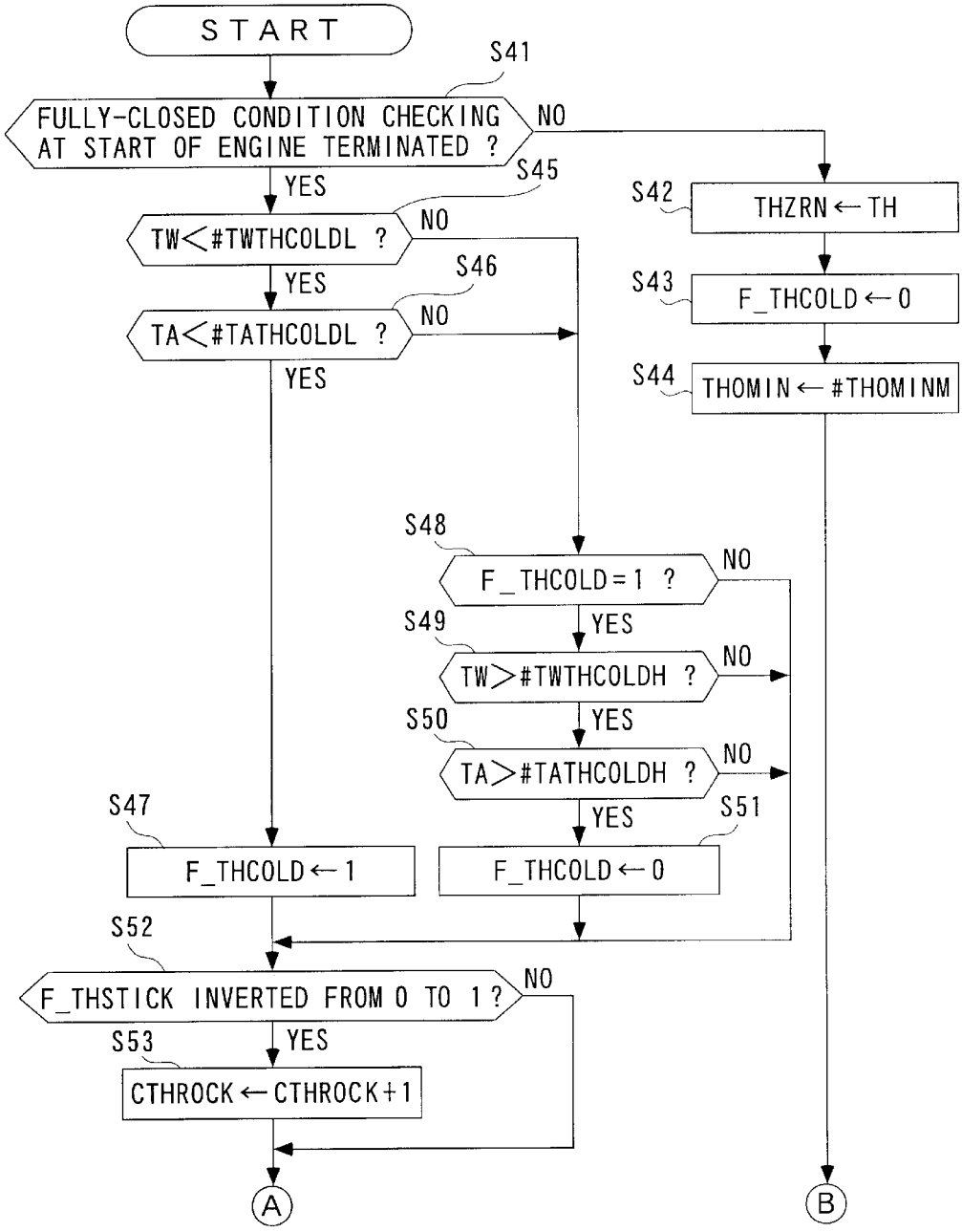
FIG. 3 is a flowchart of a process for coping with the problem of a frozen state of the throttle valve.
Figure 4:
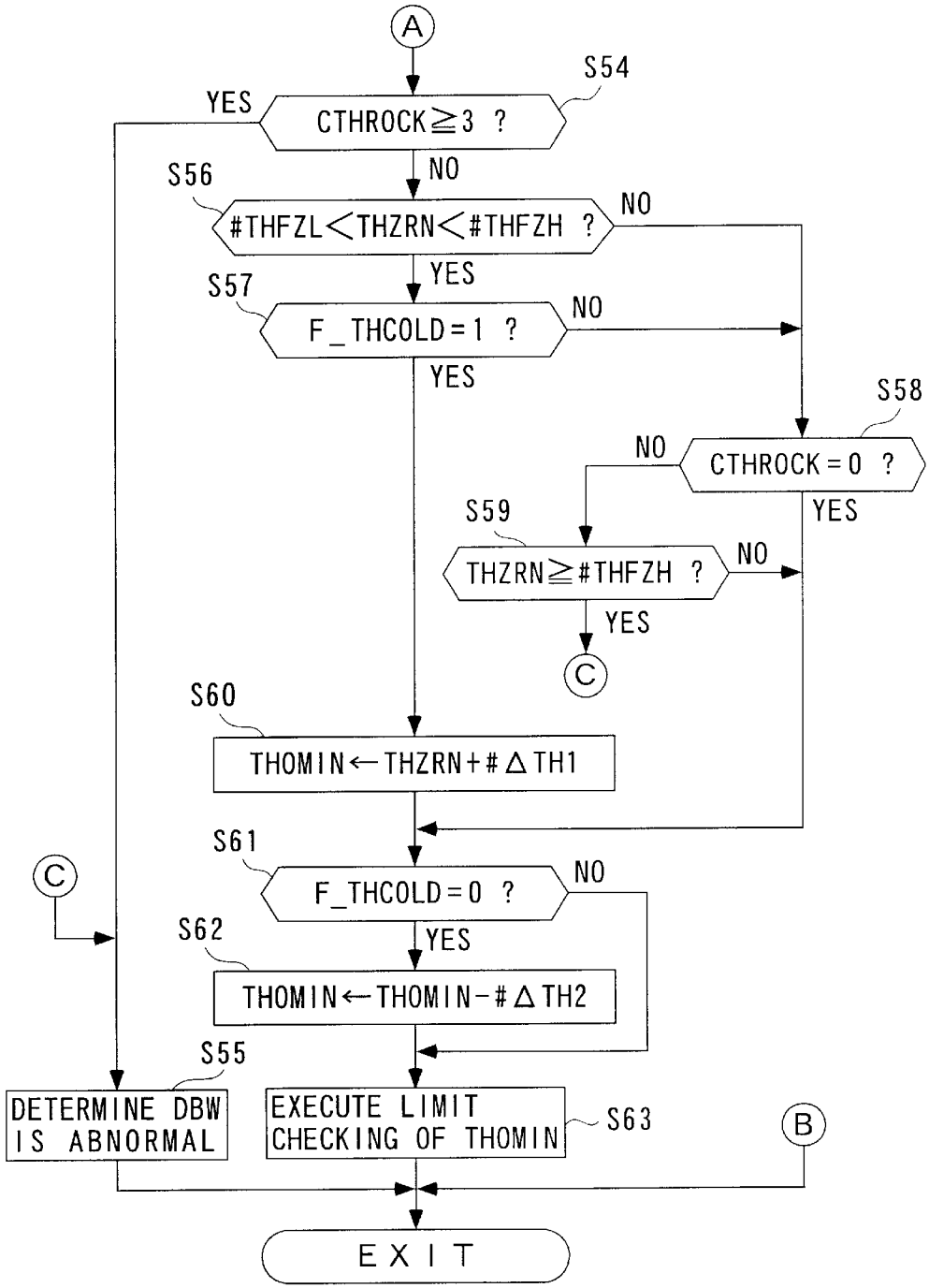
FIG. 4 is a continuation of the FIG. 3 flowchart.

FIGS. 3 and 4 are a flowchart of a process for coping with the problem of a frozen state of the throttle valve. This process estimates whether or not the throttle valve 8 is frozen and sets a lower limit value (hereinafter referred to as "the target opening lower limit value") THOMIN of the target degree of opening of the throttle valve 8 according to the result of the detection. First, in a step 41, it is determined whether or not the process at the start of the engine 3 has been terminated. If the answer to this question is negative (NO), the throttle valve opening TH detected in the process for checking a fully-closed condition of the throttle valve 8 is set to the smallest degree of opening THZRN in a step 42, a throttle freeze flag F_THCOLD is set to 0 in a step 43, and in the next step 44, the target opening lower limit value THOMIN is set to a minimum value #THOMINM (e.g. 0.3 degrees), followed by terminating the program.

If the answer to the question of the step 41 is affirmative (YES), i.e. if the process for checking a fully-closed condition of the throttle valve 8 has been terminated, it is determined in a step 45 whether or not the engine coolant temperature TW is lower than a first predetermined TW temperature #TWTHCOLDL (e.g. −5° C.). If the answer to this question is affirmative (YES), it is determined in a step 46 whether or not the intake air temperature TA is lower than a first predetermined TA temperature #TATHCOLDL (e.g. −10° C.). If the answer to this question is affirmative (YES), i.e. if the conditions of TW<#TWTHCOLDL and TA<#TATHCOLDL hold, it is judged that the temperature of the throttle valve 8 is lowered to a value at which the throttle valve 8 can be frozen, so that the throttle freeze flag F_THCOLD is set to 1 to indicate the fact in a step 47, followed by the program proceeding to a step 52, referred to hereinafter.

On the other hand, if either of the answers to the questions of the steps 45 and 46 is negative (NO), i.e. if TW≧#TWTHCOLDL or TA≧#TATHCOLDL holds, it is determined in a step 48 whether or not the throttle freeze flag F_THCOLD assumes 1. If the answer to this question is negative (NO), i.e. if the throttle freeze flag F_THCOLD assumes 0, the program immediately proceeds to the step 52, whereas if the answer to the question of the step 48 is affirmative (YES), i.e. if the throttle freeze flag F_THCOLD assumes 1, it is determined in a step 49 whether or not the engine coolant temperature TW is higher than a second predetermined TW temperature #TWTHCOLDH (e.g. 40° C.) higher than the first predetermined TW temperature #TWTHCOLDL, and it is determined in a step 50 whether or not the intake air temperature TA is higher than a second predetermined TA temperature #TATHCOLDH (e.g. 0° C.) higher than the first predetermined TA temperature #TATHCOLDL. If both of the answers to the questions of the steps 49 and 50 are affirmative (YES), i.e. if TW>#TWTHCOLDH and TA>#TATHCOLDH hold, it is judged that the temperature of the throttle valve 8 has risen to a value at which the throttle valve 8 cannot be frozen, and hence the throttle freeze flag F_THCOLD is set to 0 to indicate the fact in a step 51, followed by the program proceeding to the step 52. On the other hand, if either of the answers to the questions of the steps 49 and 50 is negative (NO), i.e. if TW≦#TWTHCOLDH or TA≦#TATHCOLDH holds, the program immediately proceeds to the step 52.

In the step 52, it is determined whether or not the above-mentioned throttle stick flag F_THSTICK set in the FIG. 2 sticking-detecting process has been inverted from 0 to 1 in the present loop. If the answer to this question is affirmative (YES), i.e. if the present loop is immediately after the throttle valve 8 is changed from an unstuck state to a stuck state, a counter CTHROCK is incremented in a step 53, followed by the program proceeding to a step 54, whereas if the answer to the question of the step 52 is negative (NO), the program skips the step 53 to proceed to the step 54.

In the step 54, it is determined whether or not the count of the counter CTHROCK is equal to or larger than 3. If the answer to this question is affirmative (YES), i.e. if sticking of the throttle valve 8 has been detected three or more times after the start of the engine 3, it is determined in a step 55 that the DBW 20 has gone out of order, and energization of the motor 10 is stopped, for example, such that the throttle valve opening TH is controlled to the default opening degree, followed by terminating the program.

If the answer to the question of the step 54 is negative (NO), it is determined in a step 56 whether or not the smallest degree of opening THZRN is within a predetermined range defined by a first predetermined degree of opening #THFZL and a second predetermined degree of opening #THFZH. As clearly shown in the above description, the smallest degree of opening THZRN is set in the step 42 in FIG. 3 at the start of the engine 3 when the process for checking a fully-closed condition of the throttle valve 8 is being carried out, or in the step 32 in FIG. 2 after the start of the engine 3 when it is detected that the throttle valve 8 is stuck. Further, the first predetermined degree of opening #THFZL corresponds to a degree of opening of the throttle valve 8 fully closed in a normal state where the valve is not frozen or free from other defective conditions, and is set e.g. to two degrees. The second predetermined degree of opening #THFZH corresponds to the default opening degree and is set to eight degrees, for example. If the answer to the question of the step 56 is affirmative (YES), i.e. if #THFZL<THZRN<#THFZH holds, it is determined in a step 57 whether or not the throttle freeze flag F_THCOLD assumes 1. If the answer to this question is affirmative (YES), i.e. if the smallest degree of opening THZRN is larger than the first predetermined degree of opening #THFZL, and smaller than the second predetermined degree of opening #THFZH, and at the same time the throttle freeze flag F_THCOLD assumes 1, it is judged that the throttle valve 8 is not closed to the normal fully-closed position since it is frozen, so that the program proceeds to a step 60, wherein the target opening lower limit value THOMIN is set to a value determined by adding a predetermined incremental amount #ΔTH1 (e.g. 0.3 degrees) to the smallest degree of opening THZRN.

As described hereinabove, when the smallest degree of opening THZRN, which is set when the process for checking a fully-closed condition of the throttle valve 8 is being executed at the start of the engine 3, or when sticking of the throttle valve 8 is detected after the start of the engine 3, is larger than the first predetermined degree of opening #THFZL, and smaller than the second predetermined degree of opening #THFZH, and at the same time, the throttle freeze flag F_THCOLD is set to 1 due to the determination that the temperature of the throttle valve 8 is low, the target opening lower limit value THOMIN is set to a value larger than the smallest degree of opening THZRN by the incremental amount #ΔTH1.

Then, the program proceeds to a step 61, wherein it is determined whether or not the throttle freeze flag F_THCOLD assumes 0. When the program proceeds from the step 60 to the step 61, the answer to this question is negative (NO) since the throttle freeze flag F_THCOLD is set to 1 in the step 57, so that the program proceeds to a step 63, wherein limit checking of the target opening lower limit value THOMIN is carried to prevent the target opening lower limit value THOMIN from becoming lower than the smallest degree of opening THZRN.

After that, when the temperature of the throttle valve 8 rises with the lapse of time, the throttle freeze flag F_THCOLD is set to 0 in the step 51 in FIG. 3, so that the answer to the question of the step 57 becomes negative (NO). In this case, it is determined in a step 58 whether or not the count of the counter CTHROCK is equal to 0. When freezing of the throttle valve 8 occurs only at the start of the engine 3, the answer to the question of the step 58 becomes affirmative (YES), and the program proceeds to the step 61, wherein it is determined whether or not the throttle freeze flag F_THCOLD assumes 0. In this case, since the throttle freeze flag F_THCOLD has been set to 0 in the step 51, the answer to the question of the step 61 is affirmative (YES), and the program proceeds to a step 62, wherein a value determined by subtracting a predetermined return amount #ΔTH2 (e.g. 0.005 degrees) from the target opening lower limit value THOMIN is set to an updated target opening lower limit value THOMIN, followed by the program proceeding to the step 63.

On the other hand, when freezing of the throttle valve 8 continues to occur even after the start of the engine 3, the answer to the question of the step 58 becomes negative (NO). In this case, it is determined in a step 59 whether or not the smallest degree of opening THZRN is equal to or larger than the second predetermined degree of opening #THFZH. If the answer to this question is negative (NO), the program proceeds to the steps 61 et seq., wherein the above subtraction from the target opening lower limit value THOMIN is carried out when the throttle freeze flag F_THCOLD assumes 0. As described above, the target opening lower limit value THOMIN, which was set to a larger value when the throttle valve 8 was frozen, is gradually returned to the minimum value #THOMINM since the ice is melted with a rise in the temperature of the throttle valve 8.

If the answer to the question of the step 56 is negative (NO), i.e. if the smallest degree of opening THZRN is not within the predetermined range, the program proceeds to the step 58. When no freezing occurs during execution of the process for checking a fully-closed condition of the throttle valve 8, and the throttle valve 8 is normally operating without being stuck also after the start of the engine 3, THZRN≦#THFZL holds, so that the answer to the question of the step 56 is negative (NO), and the answer to the question of the step 58 is affirmative (YES), and hence the target opening lower limit value THOMIN is set to the minimum value #THOMINM by executing the step 63.

On the other hand, if the throttle valve 8 is stuck in the state of THZRN≧#THFZH after the start of the engine 3, both of the answers to the questions of the steps 56 and 58 are negative (NO), and further the answer to the question of the step 59 is affirmative (YES). In this case, the program proceeds to the step 55, wherein it is determined the DBW 20 has gone out of order, followed by terminating the program.

As described hereinbefore, according to the present embodiment, when the smallest degree of opening THZRN, which is set when the process for checking a fully-closed condition of the throttle valve 8 is being executed at the start of the engine 3, or when sticking of the throttle valve 8 is detected after the start of the engine 3, is larger than the first predetermined degree of opening #THFZL, and smaller than the second predetermined degree of opening #THFZH, and at the same time the throttle freeze flag F_THCOLD is set to 1 due to the determination that the temperature of throttle valve 8 is low, the target opening lower limit value THOMIN is set to a value larger than the smallest degree of opening THZRN by the incremental amount #ΔTH1. This positively prevents the throttle valve 8 from abutting or striking against frozen ice, whereby the throttle valve 8 can be controlled to the target degree of opening without any trouble.

After that, when the temperature of the throttle valve 8 has risen, the target opening lower limit value THOMIN which was set to the larger value is gradually returned to the minimum value #THOMINM by each time subtracting the return amount #ΔTH2 therefrom. This makes it possible to control the throttle valve 8 within a normal range of target degrees of opening.

Further, when freezing of the throttle valve 3 occurs, the target opening lower limit value THOMIN is set to a value which the throttle valve 8 can actually reach. This prevents the target degree of opening from being set to a value that the throttle valve 8 cannot reach. Further, even if a failure determination process in carried out in which the DBW 20 is determined to be abnormal when the difference between the target degree of opening and the throttle valve opening TH is equal to or larger than a predetermined value, it is possible to prevent the determination from becoming erroneous determination due to the freezing of the throttle valve 8.

Figure 5:
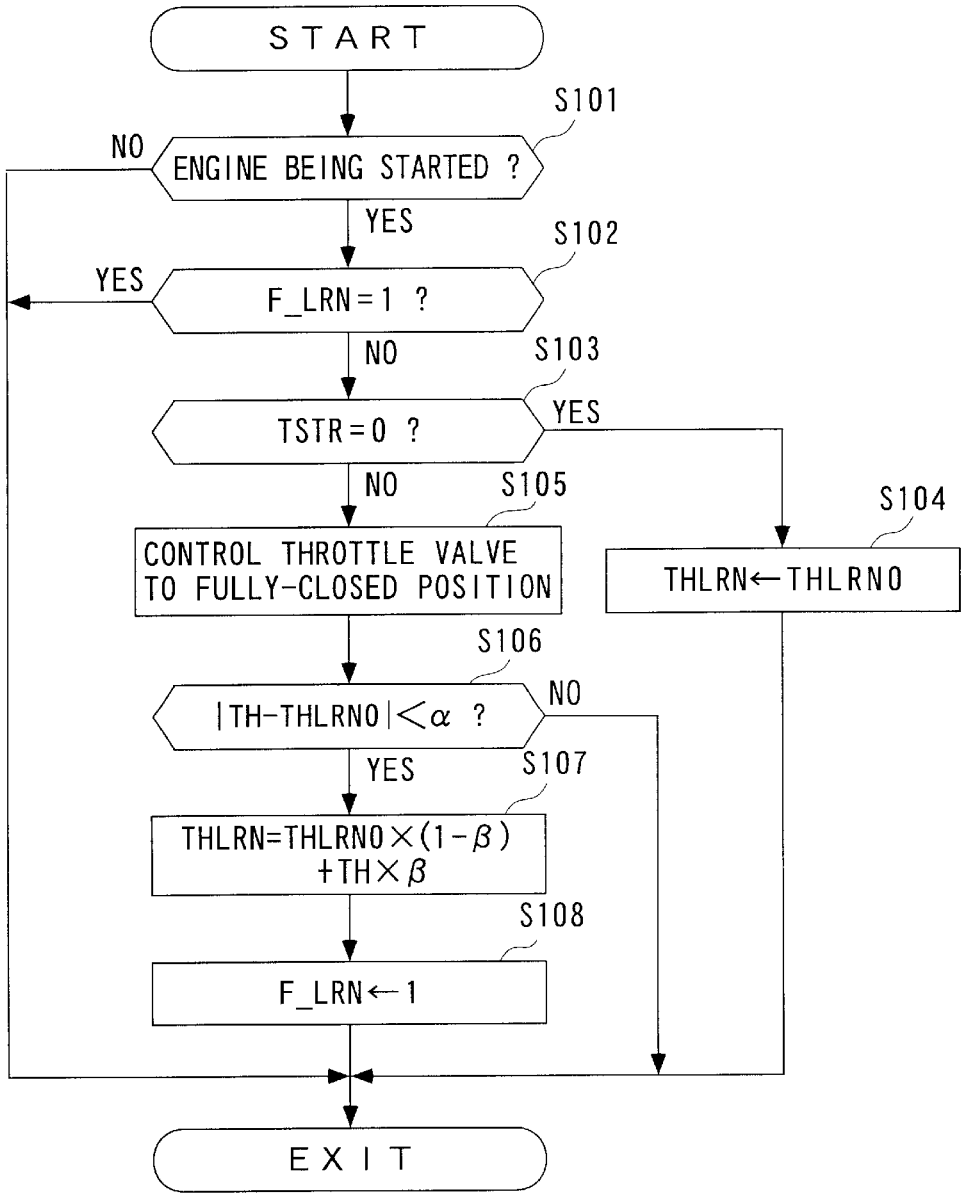
FIG. 5 is a flowchart showing a process for calculating a learned fully-closed position value THLRN of the degree of opening of the throttle valve.

Although in the process for coping with the problem of a frozen state of the throttle valve 8, described hereinabove with reference to FIGS. 3 and 4, the first predetermined degree of opening #THFZL (see the step 56 in FIG. 4), which is a fixed value, is employed as a predetermined degree of opening for estimating whether or not the throttle valve 8 is frozen, this is not limitative, but in place of the first predetermined degree of opening #THFZL, a learned fully-closed position value THLRN may be used, which is determined by learning the throttle valve opening TH in the state of the throttle valve 8 being controlled to the fully-closed position. FIG. 5 is a flowchart for a process for calculating the learned fully-closed position value THLRN. First, in a step 101, it is determined whether or not the engine 3 is being started. If the answer to this question is negative (NO), i.e. if the engine 3 has already been started to terminate the starting operation, the present program is immediately terminated.

If the answer to the question of the step 101 is affirmative (YES), i.e. if the engine 3 is being started, it is determined in a step 102 whether or not a learning termination flag F_LRN assumes 1. If the answer to this question is affirmative (YES), i.e. if learning of the learned fully-closed position value THLRN has been terminated, the present program is immediately terminated. If the answer to the question is negative (NO), i.e. if the learning has not been terminated, it is determined in a step 103 whether or not the value of a post-start up timer TSTR assumes 0. The post-start up timer TSTR is set to a predetermined time period (e.g. five seconds) when an ignition switch, not shown, of the automotive vehicle is turned on.

If the answer to the question of the step 103 is negative (NO), i.e. if the predetermined time period has not yet elapsed after the start of the engine 3, the throttle valve 8 is controlled to the fully-closed position thereof in a step 105, and it is determined in a step 106 whether or not the absolute value of a value determined by subtracting the immediately preceding value THLRN0 of the learned fully-closed position value from the present throttle valve opening TH is smaller than a predetermined value $\alpha$ (e.g. 0.2 degrees). If the answer to this question is negative (NO), i.e. if the difference between the throttle valve opening TH and the immediately preceding value THLRN0 of the learned fully-closed position value is larger than the predetermined value $\alpha$, the present program is terminated. On the other hand, if the answer to the question is affirmative (YES), it is judged that the throttle valve opening TH has converged to a value close to the immediately preceding value THLRN0 of the learned fully-closed position value, so that in a step 107, the learned fully-closed position value THLRN is updated by using the following equation (1):

$$THLRN=THLRN0\times(1-\beta)+TH\times\beta \quad (1)$$

where $\beta$ represents a weighting coefficient the value of which is set to $0<\beta<1$.

Then, the program proceeds to a step 108, wherein the learning termination flag F_LRN is set to 1 to indicate that the learning of the learned fully-closed position value THLRN has been terminated, followed by terminating the program. After the learning termination flag F_LRN has been set to 1 as described above, the answer to the question of the step 102 becomes affirmative (YES), whereby learning operation is not carried out thereafter.

On the other hand, if the answer to the question of the step 103 is affirmative (YES), it is judged that the throttle valve opening TH has not converged close to the immediately preceding value THLRN0 of the learned fully-closed position value although the predetermined time period has elapsed after the start of the engine 3, so that the immediately preceding value THLRN0 is set to the present value of the learned fully-closed position value in a step 104, followed by terminating the program without updating the value.

The learned fully-closed position value THLRN learned as above is used in place of the first predetermined degree of opening #THFZL in the step 56 in FIG. 4, whereby it is possible to accurately determine whether or not the throttle valve 8 is frozen while causing a change in the operating characteristic of the throttle valve 8 to be reflected on the determination.

It should be noted that the present invention is not limited to the embodiments described above, but can be practiced in various forms. For example, if the engine 3 is idling with the target opening lower limit value THOMIN of the throttle valve 8 being set to a large degree of opening after it is determined that the throttle valve 8 is frozen, there is a fear that the amount of intake air is increased to increase the idle rotational speed. To compensate for the increase in idle rotational speed, ignition timing control may be carried out to expand the limit of retardation of ignition timing for the idle rotational speed control in comparison with that applied when it is not determined that the throttle valve 8 is frozen so as to enable reduction of the engine rotational speed, thereby ensuring convergence of the idle rotational speed to a target idle rotational speed.

It is further understood by those skilled in the art that the foregoing is a preferred embodiment of the invention, and that various changes and modifications may be made without departing from the spirit and scope thereof.

What is claimed is:

1. A throttle control system for an internal combustion engine, for controlling a degree of opening of a throttle valve arranged in an intake system of the engine, the throttle control system comprising:

throttle valve opening-detecting means for detecting the degree of opening of the throttle valve;

target opening-setting means for setting a target degree of opening for control of the degree of opening of the throttle valve;

smallest opening-detecting means for detecting a smallest degree of opening of the throttle valve after a start of the engine;

throttle valve temperature-detecting means for detecting a temperature of the throttle valve; and target opening lower limit value-setting means for setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

2. A throttle control system according to claim 1, wherein the smallest degree of opening is a degree of opening of the throttle valve detected during control of the throttle valve to a fully closed position, at a start of the engine.

3. A throttle control system according to claim 1, including stuck state-detecting means for detecting a stuck state of the throttle valve, and wherein the smallest degree of opening is a degree of opening of the throttle valve detected when said stuck state-detecting means detects the stuck state of the throttle valve, after a start of the engine.

4. A throttle control system according to claim 1, wherein the predetermined degree of opening is a degree of opening of the throttle valve to be detected when the throttle valve is normally controlled to a fully-closed position.

5. A throttle control system according to claim 1, wherein the predetermined degree of opening is set according to a learned fully-closed position value obtained by learning the degree of opening of the throttle valve detected when the throttle valve is controlled to a fully-closed position during a predetermined operation of the engine.

6. A throttle control system according to claim 1, further comprising means for progressively degreasing the lower limit value of the target degree of opening from the degree of opening larger than the smallest degree of opening of the throttle valve as the temperature of the throttle valve detected by said throttle valve temperature-detecting means rises.

7. A throttle control system according to claim 1, wherein said throttle valve temperature-detecting means detects at least one of a temperature of intake air and a temperature of coolant of the engine as the temperature of the throttle valve.

8. A throttle control system for an internal combustion engine, for controlling a degree of opening of a throttle valve arranged in an intake system of the engine, the throttle control system comprising:

a throttle valve opening-detecting module for detecting the degree of opening of the throttle valve;

a target opening-setting module for setting a target degree of opening for control of the degree of opening of the throttle valve;

a smallest opening-detecting module for detecting a smallest degree of opening of the throttle valve after a start of the engine;

a throttle valve temperature-detecting module for detecting a temperature of the throttle valve; and a target opening lower limit value-setting module for setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

9. A throttle control system according to claim 8, wherein the smallest degree of opening is a degree of opening of the throttle valve detected during control of the throttle valve to a fully closed position, at a start of the engine.

10. A throttle control system according to claim 8, including a stuck state-detecting module for detecting a stuck state of the throttle valve, and wherein the smallest degree of opening is a degree of opening of the throttle valve detected when said stuck state-detecting means detects the stuck state of the throttle valve, after a start of the engine.

11. A throttle control system according to claim 8, wherein the predetermined degree of opening is a degree of opening of the throttle valve to be detected when the throttle valve is normally controlled to a fully-closed position.

12. A throttle control system according to claim 8, wherein the predetermined degree of opening is set according to a learned fully-closed position value obtained by learning the degree of opening of the throttle valve detected when the throttle valve is controlled to a fully-closed position during a predetermined operation of the engine.

13. A throttle control system according to claim 8, further comprising a module for progressively degreasing the lower limit value of the target degree of opening from the degree of opening larger than the smallest degree of opening of the throttle valve as the temperature of the throttle valve detected by said throttle valve temperature-detecting module rises.

14. A throttle control system according to claim 8, wherein said throttle valve temperature-detecting module detects at least one of a temperature of intake air and a temperature of coolant of the engine as the temperature of the throttle valve.

15. A throttle control method for controlling a degree of opening of a throttle valve arranged in an intake system of an internal combustion engine, the throttle control method comprising the steps of:

detecting the degree of opening of the throttle valve;

setting a target degree of opening for control of the degree of opening of the throttle valve;

detecting a smallest degree of opening of the throttle valve after a start of the engine;

detecting a temperature of the throttle valve; and setting a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

16. A throttle control method according to claim 15, wherein the smallest degree of opening is a degree of opening of the throttle valve detected during control of the throttle valve to a fully closed position, at a start of the engine.

17. A throttle control method according to claim 15, including the step of detecting a stuck state of the throttle valve, and wherein the step of smallest degree of opening is a degree of opening of the throttle valve detected when the stuck state of the throttle valve is detected in the step of detecting a stuck state, after a start of the engine.

18. A throttle control method according to claim 15, wherein the predetermined degree of opening is a degree of opening of the throttle valve to be detected when the throttle valve is normally controlled to a fully-closed position.

19. A throttle control method according to claim 15, wherein the predetermined degree of opening is set according to a learned fully-closed position value obtained by learning the degree of opening of the throttle valve detected when the throttle valve is controlled to a fully-closed position during a predetermined operation of the engine.

20. A throttle control method according to claim 15, further comprising the step of progressively degreasing the lower limit value of the target degree of opening from the degree of opening larger than the smallest degree of opening of the throttle valve as the detected temperature of the throttle valve rises.

21. A throttle control method according to claim 15, wherein the step of detecting a temperature of the engine includes detecting at least one of a temperature of intake air and a temperature of coolant of the engine as the temperature of the throttle valve.

22. An engine control unit including a control program for causing a computer to carry out control of a degree of opening of a throttle valve arranged in an intake system of an internal combustion engine, wherein the control program causes the computer to detect the degree of opening of the throttle valve, set a target degree of opening for control of the degree of opening of the throttle valve, detect a smallest degree of opening of the throttle valve after a start of the engine, detect a temperature of the throttle valve, and set a lower limit value of the target degree of opening to a degree of opening larger than the smallest degree of opening of the throttle valve when the detected smallest degree of opening is larger than a predetermined degree of opening and at the same time the detected temperature of the throttle valve is lower than a predetermined temperature.

23. An engine control unit according to claim 22, wherein the smallest degree of opening is a degree of opening of the throttle valve detected during control of the throttle valve to a fully closed position, at a start of the engine.

24. An engine control unit according to claim 22, wherein the control program causes the computer to detect a stuck state of the throttle valve, and the smallest degree of opening is a degree of opening of the throttle valve detected when the stuck state of the throttle valve is detected, after a start of the engine.

25. An engine control unit according to claim 22, wherein the predetermined degree of opening is a degree of opening of the throttle valve to be detected when the throttle valve is normally controlled to a fully-closed position.

26. An engine control unit according to claim 22, wherein the predetermined degree of opening is set according to a learned fully-closed position value obtained by learning the degree of opening of the throttle valve detected when the throttle valve is controlled to a fully-closed position during a predetermined operation of the engine.

27. An engine control unit according to claim 22, wherein the control program causes the computer to progressively degrease the lower limit value of the target degree of opening from the degree of opening larger than the smallest degree of opening of the throttle valve as the detected temperature of the throttle valve rises.

28. An engine control unit according to claim 22, wherein the control program causes the computer to detect at least one of a temperature of intake air and a temperature of coolant of the engine as the temperature of the throttle valve.

* * * * *